US006346661B1

(12) United States Patent
Yaskoweak

(10) Patent No.: US 6,346,661 B1
(45) Date of Patent: Feb. 12, 2002

(54) COMBINATION GUITAR AND BASS

(76) Inventor: Mark A. Yaskoweak, 144 S. Washington St., Apt. #1, Wilkesbarre, PA (US) 18701

( * ) Notice: Subject to any disclaimer, the term of this patent is extended or adjusted under 35 U.S.C. 154(b) by 0 days.

(21) Appl. No.: 09/693,791

(22) Filed: Oct. 20, 2000

(51) Int. Cl.[7] ..... G10D 1/08

(52) U.S. Cl. ..... 84/267; 84/290; 84/291; 84/297 R; 84/312 R

(58) Field of Search ..... 84/267, 290, 291, 84/297 R, 312 R

(56) References Cited

U.S. PATENT DOCUMENTS

| | | | | | |
|---|---|---|---|---|---|
| 3,635,116 | A | * | 1/1972 | Pelensky | 84/291 |
| 3,990,341 | A | * | 11/1976 | Pace, Sr. | 84/313 |
| 4,142,436 | A | * | 3/1979 | Chapman | 84/723 |
| 4,343,217 | A | | 8/1982 | Brody | 84/1.16 |
| 4,377,101 | A | * | 3/1983 | Santucci | 84/743 |
| 4,483,233 | A | * | 11/1984 | Benson | 84/263 |
| 4,539,887 | A | | 9/1985 | Bjerkas | 84/314 |
| 4,887,506 | A | * | 12/1989 | Freed | 84/727 |
| 5,113,737 | A | | 5/1992 | Grerory | 84/267 |
| 5,175,387 | A | | 12/1992 | Greory | 84/267 |
| 5,251,526 | A | | 10/1993 | Hill | 84/263 |
| 5,315,910 | A | | 5/1994 | Soupios | 84/453 |
| 5,581,043 | A | | 12/1996 | Bowar | 84/291 |

FOREIGN PATENT DOCUMENTS

DE 4332972 9/1994

OTHER PUBLICATIONS

Guitar Gear, Edited by John Brosh Quill/ A Guitar Player Book, New York, 1985.*

* cited by examiner

*Primary Examiner*—Shih-Yung Hsieh
(74) *Attorney, Agent, or Firm*—Charles A. Wilkinson; Clinton H. Wilkinson

(57) ABSTRACT

A combination guitar and bass guitar and method of playing is provided in which the bass strings are distributed between matched guitar strings so that adjacent bass and guitar strings can be plucked substantially simultaneously by a player, resulting in the simultaneous playing of bass and guitar by a single player. Various combinations of bass strings interspersed in or between guitar strings are disclosed. The guitar and bass can also be played independently of each other in the normal manner.

22 Claims, 4 Drawing Sheets

COMBINATION GUITAR AND BASS

BACKGROUND OF THE INVENTION

1. Field of the Invention

This invention relates generally to stringed musical instruments, and more particularly to a new musical instrument that allows guitar and bass notes to be played simultaneously while retaining the separate functionality of a regular guitar or bass guitar.

2. Preliminary Discussion

Traditionally, a guitar and bass guitar, frequently referred to merely as a bass, have been separate instruments, with both instruments being available in acoustic or electric versions, although a bass is more often found in an electric version than an acoustic version. A typical acoustic guitar has a hollow body and between six and twelve strings, a standard electric guitar has a solid body and six strings, and a standard electric bass guitar, or bass, has a solid body and four strings.

The electric bass is essentially an electric guitar modified to hold heavier-gauge strings to facilitate the playing of lower-pitched notes. Guitar and bass strings are usually ordered from lowest to highest, based on thickness. The traditional six string guitar notes, in order from lowest to highest, are low E, A, D, G, B, and high E, while the traditional bass notes, in order from lowest to highest, are E, A, D, and G. The bass notes are typically identical to the bottom four guitar string notes, but one octave lower. The frequency of vibration of the standard A string on a guitar is 110 vibrations per second, or 110 Hertz (Hz). The lowest note on a standard guitar is E at 83 Hz. However, a bass guitar can typically play down to 41 Hz. A twelve string acoustic guitar is usually tuned to the same notes as a six string guitar but having pairs of adjacent strings tuned to the same note, resulting in the string pattern E, E, A, A, D, D, G, G, B, B, E, E. Each pair can be tuned in unison, with each string in a pair having the same pitch, or alternatively tuned to give the same note but one octave apart. The primary advantage of a twelve-string acoustic guitar over a six-string acoustic guitar is that having twelve strings produces a much fuller and richer sound than six strings.

An electric guitar has a solid rather than a hollow body so that the body does not vibrate in sympathy with the strings. Instead, pickups placed under the strings convert the vibrations into electronic signals, which are then amplified by a loudspeaker.

The pitch or tone of a vibrating string is determined almost entirely by the frequency. High frequency results in a high pitch, while low frequency results in a low pitch. The pitch or frequency of a vibrating string is dependent on several factors. First, the size of the string is important, since more massive strings vibrate more slowly resulting in a lower pitch. Second, the tension on a string, which can be changed using the tuning pegs or machine heads, can change the frequency. The tighter or more tension on a string, the higher the pitch. Third, the pitch is dependent on the length of the string free to vibrate. For example, firmly holding a string against the fingerboard will shorten the string, giving it a higher pitch. Finally, the pitch is affected by the mode of vibration.

Often, a band or musical group performing live requires the sounds produced by both a guitar and bass to play a song or composition. To accomplish this, usually a separate bass and guitar must be used. It is not uncommon for musicians to learn to play both a guitar and bass so they can switch instruments throughout a performance depending upon the type of sound that is required by a particular song. There are many instances, however, when a song requires both guitar and bass sounds to be played simultaneously, or at least closely following. In such instances, a musician cannot simply switch instruments, which is distracting, takes time, and is generally impractical. In addition, this also requires a musician to carry both a guitar and bass at all times, or, if guitar and bass sounds are to be produced simultaneously, two different musicians must be present. Thus, there is a need for an instrument which can play both guitar and bass sounds simultaneously, thereby giving musicians the flexibility to play a wider range of songs or notes as required. The present inventor has recognized this need and, after much experimentation, has developed a new instrument which combines the traditional guitar and bass in a manner which allows chords including both guitar and bass notes to be played simultaneously, in rapid succession, or even separately, without having to switch instruments or take other time-consuming or impractical steps.

3. Description of Related Art

While traditionally a guitar and bass have been separate instruments, the prior art exhibits numerous altered or enhanced guitars, including a few combination guitar and bass instruments. However, none of such instruments combines a guitar and bass in the same manner as the present inventor so that the guitar and bass portions may be easily played simultaneously or separately. In addition, the construction of the inventor's instrument results in a well-balanced instrument, which, unlike previous guitar and bass combinations, will continue to function properly over time.

U.S. Pat. No. 4,377,101 issued to S. Santucci on Mar. 22, 1983, entitled "Combination Guitar and Bass," discloses an electric guitar and bass having larger frets than those of a conventional guitar but smaller than conventional bass frets. The Santucci instrument is not capable of being played in the same manner as the present inventor's instrument, since the six guitar strings and four bass strings in Santucci are in separate groups rather than arranged in a pattern which allows similar bass and guitar notes to be played simultaneously.

U.S. Pat. No. 4,483,233 issued to R. Benson on Nov. 20, 1984, entitled "Combined Guitar and Bass Guitar Having Eight Strings," discloses an instrument in which two of the normal strings of a guitar and bass, G and D, are used in common such that a normal six string guitar and four string bass are combined into an eight string guitar and bass having four adjacent guitar and bass strings. As with the '101 patent, the strings of the '233 patent are not arranged to facilitate simultaneous playing similar guitar and bass notes.

U.S. Pat. No. 4,539,887 issued to J. B. Bjerkas entitled "String Instrument of Guitar Type," discloses a guitar-type instrument having a fingerboard designed to correspond to the keys on a piano keyboard, so that sheet music for the piano can be used. The Bjerkas instrument has between 4 and 13 strings, depending upon the skill or desires of the musician. In addition, the distance between the frets is larger than with a conventional guitar, making it possible to press down the string between the frets and obtain a note, giving the instrument a larger tone range. While the Bjerkas instrument is innovative, it does not disclose a combination guitar and bass.

Related U.S. Pat. Nos. 5,113,737 and 5,175,387 issued to A. Grerory and both entitled "Seven String Electric Guitar," disclose an electric guitar having 24 frets, a standard set of six strings E, A, D, G, B, E, and a seventh string A. Such guitar also uses a particular "vibrato" head system to provide sustained sound, and has staggered headmachines of varying heights so that the tension in the strings can be more easily regulated.

U.S. Pat. 5,581,043 issued to R. D. Bowar on Dec. 3,1996, entitled "Overtone Enhancing Musical Instrument," discloses a ten-stringed acoustical guitar having adjustable baffles in the tone box to amplify the resolution of the musical overtones of the instrument when played. Bowar does not, however, disclose a combination guitar and bass.

Double-necked guitars are also known in the prior art, such as, for example, guitars combining an electric and acoustic guitar (U.S. Pat. No. 4,987,815 issued to G. Shockley), guitars having the necks facing in substantially opposite directions (U.S. Pat. No. 4,343,217 issued to R. Brody), or guitars with one of the necks being detachable (U.S. Pat. No. 5,315,910 issued to C. Soupios) or flexibly connected (U.S. Pat. No. 4,785,705 issued to J. Patterson), or even with the strings situated on more than one face of the neck (U.S. Pat. No. 5,251,526 issued to J. P. Hill). Although each of these instruments presumably enhances the range of notes available to a musician, the present inventor is not aware of any references showing an instrument having the particular advantages and features of his new instrument.

OBJECTS OF THE INVENTION

It is an object of the invention, therefore, to provide an instrument that functions as both a guitar and bass guitar.

It is a further object of the invention to provide an instrument that can function solely as a guitar.

It is a still further object of the invention to provide an instrument that can function solely as a bass.

It is a still further object of the invention to provide an instrument on which the strings are arranged such that similar guitar and bass notes can be easily played simultaneously or with a single stroke.

It is a still further object of the invention to provide an instrument that allows for the effective playing of guitar and/or bass chords simultaneously by a single musician.

Still other objects and advantages of the invention will become clear upon review of the following detailed description in conjunction with the appended drawings.

SUMMARY OF THE INVENTION

A new instrument is provided comprising a combination guitar and bass on which guitar and bass notes and chords can be easily played simultaneously while also retaining the individual functionality of separate guitar and bass instruments. In a preferred embodiment, an electric guitar is provided having ten strings arranged from left to right across the face of the instrument in the following order: E bass, E guitar, A guitar, A bass, A guitar, D guitar, D bass, D guitar, G guitar, B guitar. This order has two features not shown in previous stringed instruments. First, each bass string is adjacent to at least one guitar string of the same note, so that adjacent guitar and bass strings of the same note can be easily struck or played simultaneously without requiring the musician to change hand positions on the fingerboard. Second, each guitar string is adjacent to at least one other guitar string either tuned to the same note or a note following the traditional E, A, D, G, B, E string order of a guitar. For example, in the preferred embodiment the first E guitar string is adjacent to an A guitar string, which is the standard order found on a traditional guitar. This allows an E-A chord to be played as it would on a traditional guitar even with the addition of the bass strings. To accommodate the increased number of strings, the fingerboard is wider and longer than that of a traditional guitar, which also improves the balance of the instrument.

Numerous other embodiments are also contemplated wherein the number of strings can be expanded to include a full complement of bass and guitar strings arranged following the same principles. In addition, acoustic versions of the instrument are also contemplated, as are other embodiments wherein bass strings may be repeating in the same manner as the guitar strings. The inventor's instrument, having the ability to function as a standard guitar or simultaneously as a guitar and bass, is a significantly more versatile stringed instrument than is currently available which can be conveniently adapted to the needs or desires of the musician.

BRIEF DESCRIPTION OF THE DRAWINGS

The foregoing and other objects, features, and advantages of the present invention will be apparent from the following more particular description of the preferred embodiments as illustrated in the accompanying drawings in which reference characters refer to the same parts throughout the various views.

DESCRIPTION OF THE PREFERRED EMBODIMENTS

Figure 1:
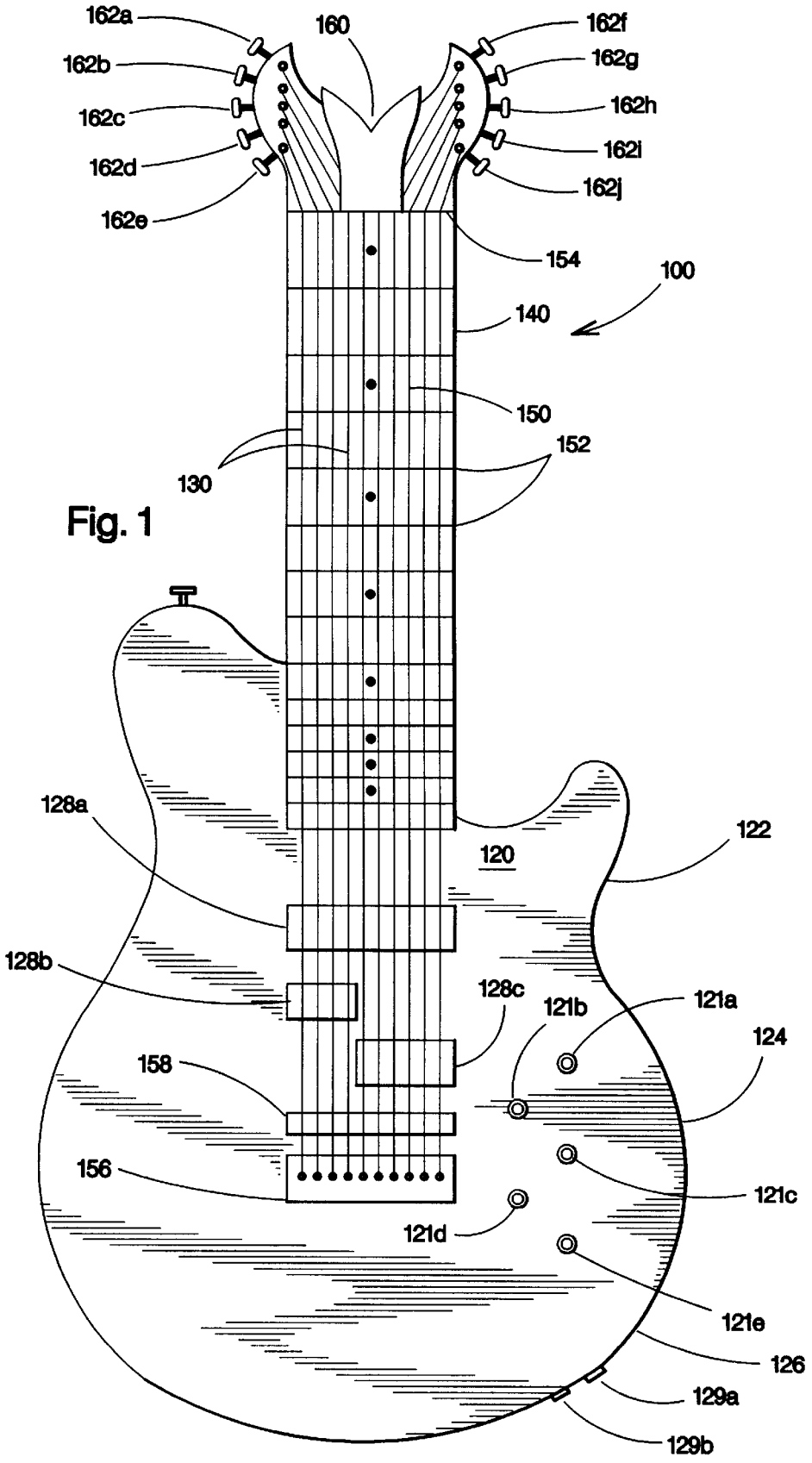
FIG. 1 is a plan view of a preferred embodiment of a string instrument in accordance with the invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention represents a significant advance in stringed instruments and more particularly in the ability of a single musician to play both a guitar and bass simultaneously. As is evident from the prior art, although combination guitar and bass instruments are known, they are limited in their range and/or ability to be played, primarily because the guitar and bass strings, although technically combined on the same instrument, are arranged or grouped separate from each other such that the guitar strings are in one group and the bass strings are in another group. While such instruments technically allow a musician to switch between playing a guitar and bass, such arrangement or grouping of the strings into guitar and bass portions significantly limits the range or ability of the musician to simultaneously play both guitar and bass portions. For example, in the U.S. Pat. No. '4,377,101 patent issued to Santucci discussed above, the instrument has a bass string and guitar string portion, whereby the strings are situated such that it would be extremely difficult if not impossible to strike, for example, the E bass and E guitar strings in the same stroke without also striking other unwanted adjacent notes. While the strings of a conventional guitar or bass are almost always arranged in order from lowest pitch to highest pitch, and generally based upon the weight and thickness or type of strings, the present inventor has found that by intermingling the guitar and bass strings in a predetermined order such that each bass string is adjacent to at least one guitar string of a similar note, and such that groups of adjacent guitar strings are ordered as they might be arranged on a standard guitar, an instrument having the ability to play a much wider variety of chords and playing techniques results which simply cannot be duplicated by any currently existing musical instruments.

While it might appear to those skilled in the art that it would be impossible or impractical to play a guitar in a coordinated manner with bass strings interposed among the guitar strings, the present inventor has found that with a careful design and matching of the strings plus a little practice, his combined guitar and bass can be played in a perfectly coordinated manner by a single player in a manner which can scarcely or not at all be distinguished by listeners from the simultaneous playing of a bass guitar and a regular guitar by two musicians. In fact, the music provided by a single player using the combined guitar and bass of the invention is even more closely coordinated and in tune between the guitar and bass than the usual use of two separate instruments.

Figure 2:
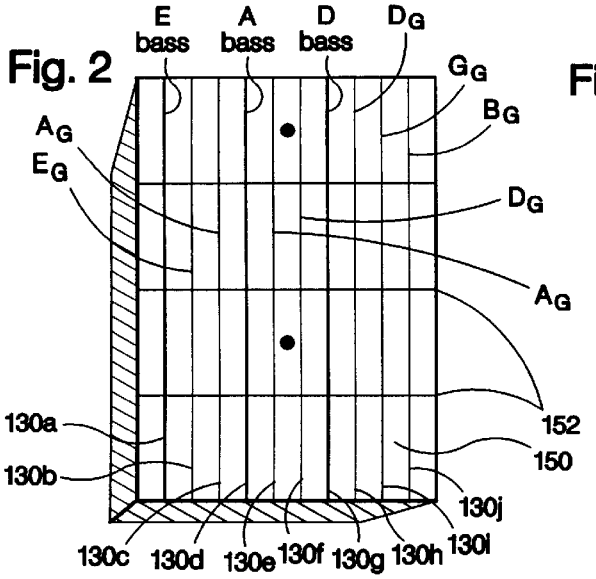
FIG. 2 is a front view of a portion of the fingerboard of the instrument shown in FIG. 1 showing the positioning of the strings.
Figure 8:
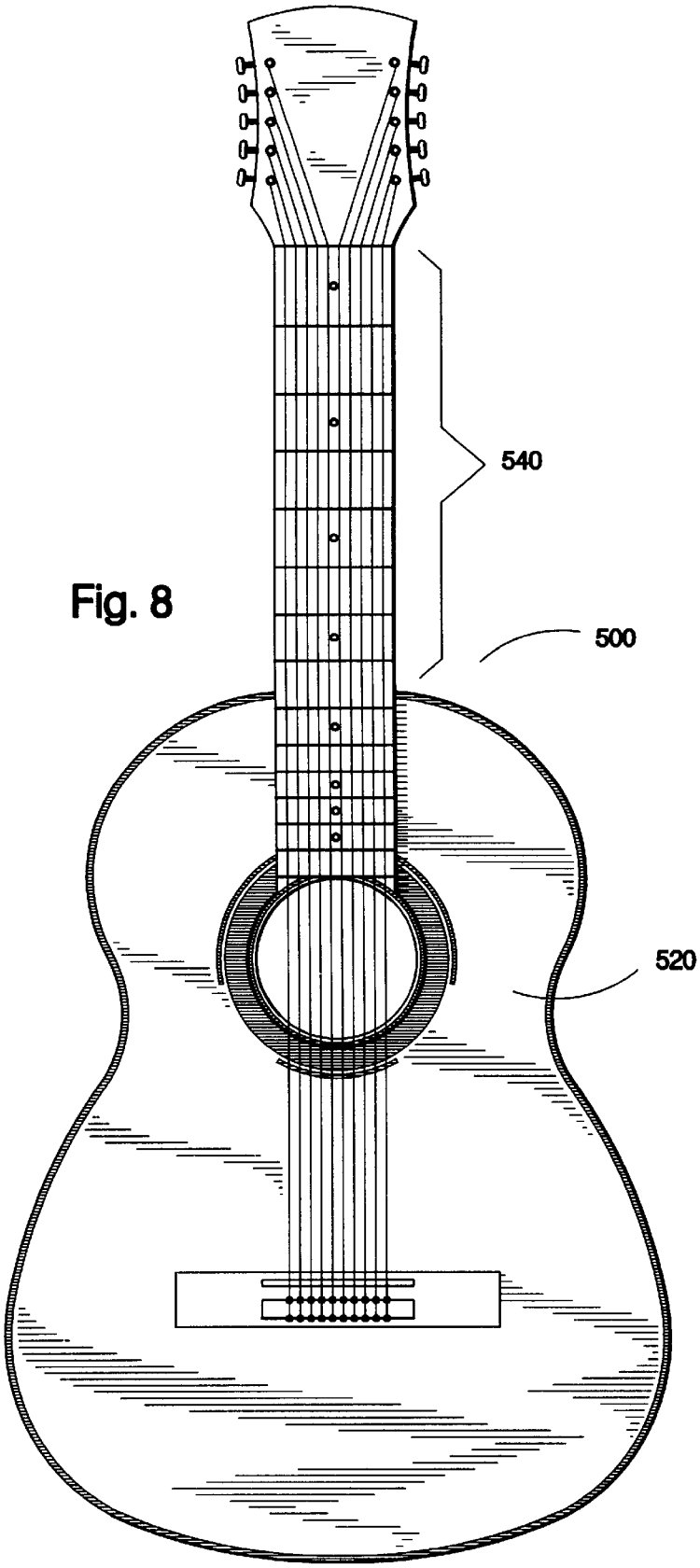
FIG. 8 is a plan view of an acoustic version of the preferred embodiment of the invention shown in FIG. 1.

Referring now to the embodiments chosen for the purpose of illustrating the present invention, FIGS. 1–3 illustrate an electric version of the stringed instrument 100, although as shown in FIG. 8 and described in more detail below, an acoustic version of the instrument is also contemplated. FIG. 1 is a top plan view of the instrument 100, having generally a body portion 120, neck portion 140, fingerboard 150, and headstock 160. The body portion 120 is solid and is preferably made from a well-seasoned or kiln-dried hardwood such as mahogany, walnut, ash, or maple. Other materials such as laminated timbers or even Plexiglas can be used, although it should be recognized that the material used can affect the sound of the guitar, since in general the denser the material, the longer the natural sustain, or length of time that a note continues to sound after the string has been struck, the instrument will have. Body portion 120 has an upper bout area 122, a thinner waist area 124, and a lower bout area 126. However, the exact shape of the body of the electric version of the instrument is not critical to its functionality.

Elongated neck portion 140 extends from the body 120. The neck 140 is secured to the body preferably by shaping one end of the neck to fit into a slot in the body and then permanently gluing the neck joint to the body, although other means such as a straight-through neck or bolt-on neck may be used. The neck can be made from a single piece of hardwood such as mahogany, maple, rosewood, or from more than one piece or laminated layers. A truss rod, not shown, is preferably set inside the neck to increase the strength of the neck and body connection. Fingerboard 150, which is generally flat but may have a slightly convex curved surface, is glued or otherwise fitted to the front of the neck and can be made from any suitable darkwood. Frets 152 are secured to the fingerboard 150 in a series of parallel cuts. In the preferred embodiment, there are twenty-four frets 152 on the fingerboard 150. Conventional twenty-four-fret spacing is used to enhance the comfort level of the instrument, although modified fret spacing may be used if desired.

Headstock or head portion 160 is situated on the distal end of the neck 140 and holds the headmachines or tuners 162*a*–162*j*. In order to accommodate a larger number of strings, the neck 140 is necessarily wider than that of a conventional guitar or bass. It is also important from both a visual standpoint and a marketing standpoint that the instrument appears to be balanced. This is accomplished in two ways. First, the portion of the neck attached to the body of the instrument is preferably slightly wider than the portion closest to the headstock, such that the width of the neck gradually decreases from the body to the headstock. Second, the neck is longer than the neck of a conventional guitar or bass.

Nut 154 is situated on the bottom of the headstock 160 at the upper end of the fingerboard 150. A plurality of strings 130, numbered individually as 130*a*–130*j* in FIGS. 2 and 3, of specific diameter, length, and placement are attached at one end to the headmachines 162*a*–162*j* and at the other end to tailpiece 156. Tailpiece 156 is preferably made from ebony, rosewood, masonia, mahogany, or walnut. Strings 130 compressively rest on one end on nut 154, situated between the fingerboard 150 and the headmachines 161*a*–161*j*, and on the other end on bridge saddle 158. In the preferred embodiment, the instrument 100 is shown having ten strings (130*a*–*j*), seven of which are guitar strings and three of which are bass strings. However, as will be illustrated in more detail below, more or less numbers of strings may also be used in accordance with the teachings of the invention. In the acoustic version of the invention shown in FIG. 8, the inventor prefers a floating bridge rather than a fixed bridge in the preferred embodiment of the instrument, which bridge is held in place simply by the tension of the strings 103*a*–*j* which pass over it, with the strings secured to the tailpiece 156. Using a floating bridge allows the intonation of the instrument to be corrected by moving such bridge backwards and forwards until the correct tone is found. Although a floating bridge can also be used in the electric version shown in FIG. 1, different types of bridge/saddle structures may also possibly be used, such as the Gibson "Tune-O-Matic," in which the height of the whole bridge can be raised or lowered, and in addition each string sits on its own individually adjustable saddle.

As mentioned above, the neck 140, fingerboard 150 and bridge 156 must be wide enough to accommodate the strings 130. For purposes of balance, strength and symmetry, the portion of the neck 140 closest to the body 120 is wider than the portion closest to the headstock 160. In the preferred embodiment, the neck is approximately ¼% inches wide at the end nearest the body, gradually decreasing along the length of th neck to a width of approximately 3¾ at the 12th fret and approximately 2¾ inches at the nut 154. The inventor has determined that the optimal scale length of the instrument 100, i.e. the total length of a vibrating open string measured from the inside edge of nut 154 to point at which the top string contacts the bridge saddle 158, is approximately 27 inches (71 cm).

Three electronic pick-ups 128*a–c* are mounted on the body 120 of the instrument beneath the strings 130 to convert the sound of the vibration of the strings into an electronic signal or AC (alternating current) impulses. The electronic signal is then fed to an amplifier and converted into sound by a loudspeaker, not shown. Individual or combinations of pick-ups can be used while playing the instrument resulting in different sounds. For example, in the preferred embodiment, the inventor uses a mid range pickup 128*a* for amplifying mid range frequencies, a low range pickup 128*b* for amplifying low frequency sounds, and a high range pickup 128*c* for amplifying higher frequencies. The midrange pickup 128*a* is preferably situated above the low and high range pickups and underneath all of the strings 130*a–j* as labeled in FIG. 2. The low range pickup 128*b* is situated under, from left to right, the lower range notes, which in the illustrated embodiment are essentially the first four strings 130*a*–130*d*, and the high range pickup 128*c* is situated under the higher range notes, which are essentially strings 130*e*–130*j*. Although other types of pickups may be used, the pickups shown in the preferred embodiment are preferably single-coil pickups having individual electronic sensors positioned underneath each string. In some instances, where a sensor is not needed or desired, a plastic piece may be inserted instead of a sensor so that such pickup does not detect the vibrations of such string.

Also situated on the body 120 are bass volume control 121*a*, guitar volume control 121*b*, first bass control tone 121*c*, guitar tone control 121*d*, and second bass tone control 121*e*. Two separate electronic pickup jacks are also preferred, shown as guitar output jack 129*a* focusing on the guitar pickups and bass output jack 129*b* focusing on the bass pickups. The use of separate guitar and bass volume controls, tone controls, pickups, and output jacks gives the musician the ability to precisely control the individual guitar and bass tones of the instrument. For instance, if a louder guitar than bass sound is desired, the guitar volume can be set louder than the bass volume. In addition, each of the pickups can be turned off and on as necessary.

As more fully described below, the exact string placement and diameter is essential to the ability of the instrument to function simultaneously as a guitar and bass as well as to retain significant functionality as a standard guitar. The string arrangement of the preferred embodiment is shown in the following table, with the bass strings shown in bold print:

TABLE 1

| String # | Note | Type of String (Guitar/Bass) |
|---|---|---|
| 1 | E | Bass |
| 2 | E | Guitar |
| 3 | A | Guitar |
| 4 | A | Bass |
| 5 | A | Guitar |
| 6 | D | Guitar |
| 7 | D | Bass |
| 8 | D | Guitar |
| 9 | G | Guitar |
| 10 | B | Guitar |

FIG. 2 is a closer front view of a portion of fingerboard 150 of the instrument, cut away along the jagged lines, showing several frets 152 and with the strings 130*a*–130*j* arranged in the order shown in Table 1. The strings 130*a*–130*j* in FIG. 2 are labeled along the upper edge of the drawing according to the type of string and the note to which it is tuned, with the subscript "B" indicating a bass guitar string and the subscript "G" indicating a regular guitar string. The bass strings, which are generally thicker than the regular guitar strings, are further labeled $B_1$–$B_3$ differentiated with a thicker or darker line than the regular strings labeled $G_1$–$G_7$.

Figure 3A:
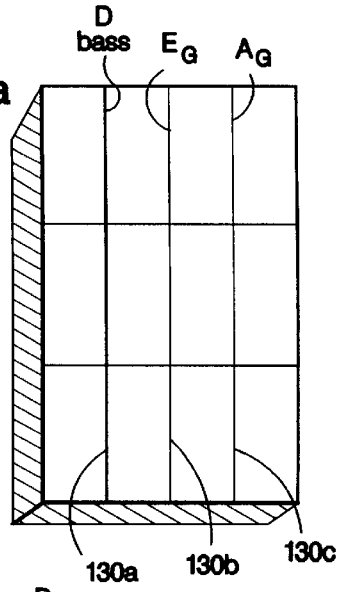
FIG. 3*a* is a view of a first section of strings of the string instrument of the invention as shown in FIG. 2.
Figure 3B:
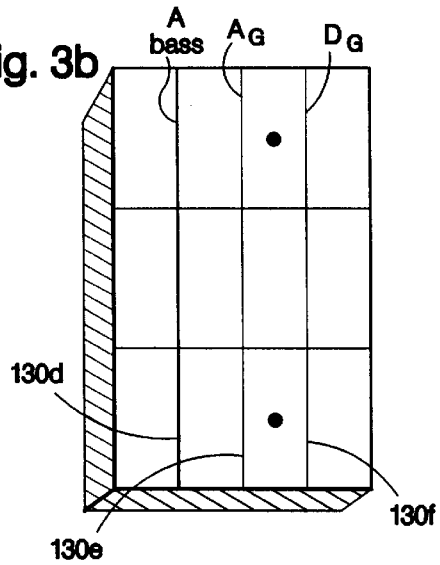
FIG. 3*b* is a view of a second section of strings of the string instrument of the invention as shown in FIG. 2.
Figure 3C:
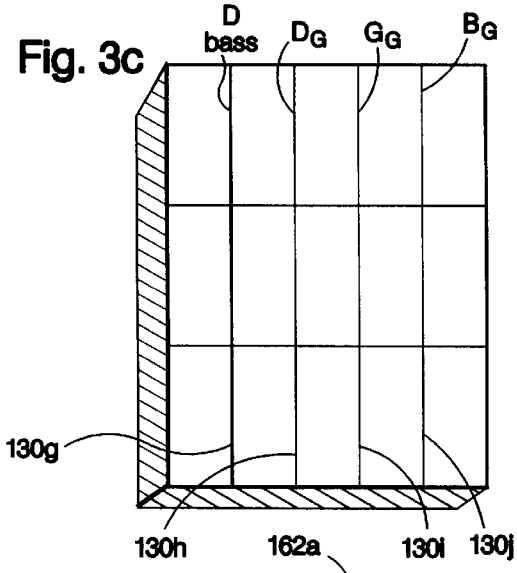
FIG. 3*c* is a view of a third section of strings of the string instrument of the invention as shown in FIG. 2.

The advantages of the particular string order of the instrument are more easily understood and explained by breaking the ten strings into three sections, as shown in FIGS. 3*a*–3*c*, consisting of two sections of three adjacent strings and one section of four adjacent strings. Note, however, that such sections are for illustrative purposes only, and that it is the overall order and placement of the strings which allows for the unique playing capabilities of the instrument. Furthermore, it is contemplated that additional strings may be added to each section or that varied string orders can be used which follow the inventor's basic principle, allowing for an even greater variety of playing options.

FIG. 3*a* shows a cut-off portion, indicated by the jagged lines, of the fingerboard 150 shown in FIG. 2, consisting of, from left to right, E bass string 130*a*, E guitar string 130*b*, and first A guitar string 130*c*. First, note that E bass string 130*a* is situated adjacent to E guitar string 130*b*. This arrangement allows a musician to easily strike both the E bass and E guitar strings in a single stroke when it is desired to play such notes virtually simultaneously. In the prior art combination guitar and bass instruments discussed above, a single stroke could not be used to strike the E bass and E guitar strings, since such strings were not adjacent to each other. Next, note that the E guitar string 130*b* is also adjacent to the first A guitar string 130*c*, which is also the case in a standard or regular guitar. This arrangement gives a musician playing the instrument 100 the ability to play an E-A chord as on a regular guitar, with or without simultaneously striking the E bass string 130*a* or any of the other strings.

FIG. 3*b* shows the second or middle section of strings on the fingerboard 150, which section is positioned directly adjacent and to the right of the first section. The second section consists of, from right to left, A bass string 130*d*, second A guitar string 130*e* and first D guitar string 130*f*. Similar to adjacent E bass and E guitar strings 130*a* and 130*b* in the first section, the A bass and second A guitar strings 130*e* and 130*f* are adjacent such that a musician can strike or play such notes virtually simultaneously whenever it is desired or is required in a particular song or musical composition. Furthermore, a chord combining the A and D guitar notes can be played by striking the second A guitar string 130*d* and first D guitar string 130*e*.

FIG. 3*c* shows the third section of strings, which is positioned directly to the right of the second section and consists of D bass string 130*g*, a D guitar string 130*h*, a G guitar string 130*i*, and a B guitar string 130*j*. As in the first two sections, a musician playing an instrument having such string positioning can simultaneously strike adjacent D bass string 130*g* and second D guitar string 130*h*. In addition, the second D guitar string 130*h*, G guitar string 130*i*, and B guitar string 130*j*, which are in the same order as on a regular guitar, are adjacent to each other, thereby allowing a musician to play such notes simultaneously as he or she might do with a regular guitar.

Referring again to FIG. 2, the advantages of the string orientation of the inventor's instrument will now be evident.

The inclusion of first and second A guitar strings 130*c* and 130*e* situated on either side of A bass string 130*d*, as well as first and second D guitar strings 130*f* and 130*h* situated on either side of D bass string 130*g*, has several advantages. First, because each bass string is adjacent to a guitar string having the same note, such adjacent bass and guitar notes can be easily played virtually simultaneously without the need for a separate bass and guitar instrument or without having to try to strike or pluck non-adjacent strings. Note that a musician desiring to play the A guitar and A bass notes together can strike either the first or second A string 130*c* or 130*e*, or both, with the A bass string 130*d*. Similarly, the D bass string 130*g* can be played with either or both of the D guitar strings 130*f* and 130*h*. In addition, another important advantage of the instrument is that by using the inventor's string orientation, the ability to play common guitar chords is not hindered by intermingling the bass strings with the guitar strings. For example, a musician can easily play the E guitar and first A guitar strings 130*b* and 130*c* simultaneously, but without the addition of second A guitar string 130*e* after the A bass string 130*d*, it would not be possible to play an A guitar string simultaneously with the D guitar string without either hitting another string or strings or by plucking the strings individually. Similarly, without the addition of a second D guitar string, it would not be possible to play a D-G-B chord, which can be done on the inventor's instrument by striking the D, G, and B strings 130*h*–130*j* in a single stroke. Thus, the present invention represents a significant advance in stringed instruments by providing an instrument having the basic functionality of a regular guitar and in addition having the ability to be played as both a guitar and bass simultaneously.

Figure 4:
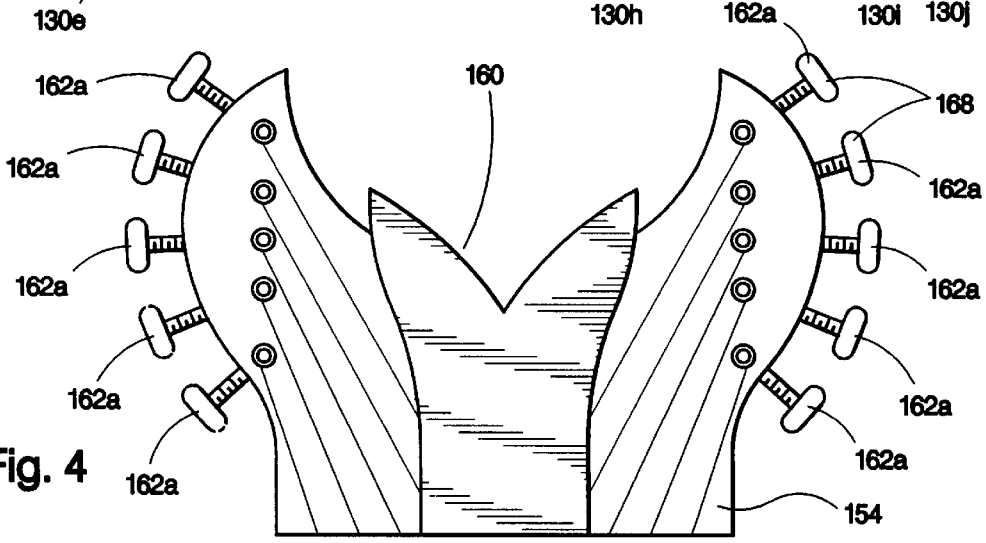
FIG. 4 is a front view of the headstock and headmachines of a stringed instrument in accordance with the invention.

FIG. 4 shows a more detailed view of the headstock 160 and machine heads 162*a*–162*j* of the instrument 100. The machine heads 162*a*–162*j* provide the mechanism for tuning the strings 130*a*–130*j* of the instrument by increasing or reducing the tension on each string, thus raising or lowering the pitch. Each machine head has a capstan or post 166 around which a string is wrapped, a base portion 167 located adjacent to the headstock 160, and a tuning knob 168 which, when turned, rotates the post 166. Each post 166 may be of a varying height so that the thinner strings can be properly tightened against the nut 154. A locking system is preferably used to hold the strings at a particular tension. As shown in FIG. 4, there are five machine heads 162*a*–*e*on the left side of the headstock, and five machine heads 1621*f*–*j* on the right side of the headstock. In the preferred embodiment, strings 130*a*–130*j* are attached are to headmachines 162*a*–1621*j*, respectively.

While the preferred embodiment of the invention illustrates an electric guitar having 10 strings, other embodiments are envisioned which have a greater or lesser number of strings which give the instrument even greater flexibility and functionality while still retaining the same advantages. For example, Table 2 shows an alternative string arrangement wherein 13 bass and guitar strings are oriented as follows:

TABLE 2

| String # | Note | Type of String (Guitar/Bass) |
|---|---|---|
| 1 | E | Bass |
| 2 | E | Guitar |
| 3 | A | Guitar |
| 4 | D | Guitar |

TABLE 2-continued

| String # | Note | Type of String (Guitar/Bass) |
|---|---|---|
| 5 | A | Bass |
| 6 | A | Guitar |
| 7 | D | Guitar |
| 8 | G | Guitar |
| 9 | D | Bass |
| 10 | D | Guitar |
| 11 | G | Guitar |
| 12 | B | Guitar |
| 13 | E | Guitar |

Figure 5:
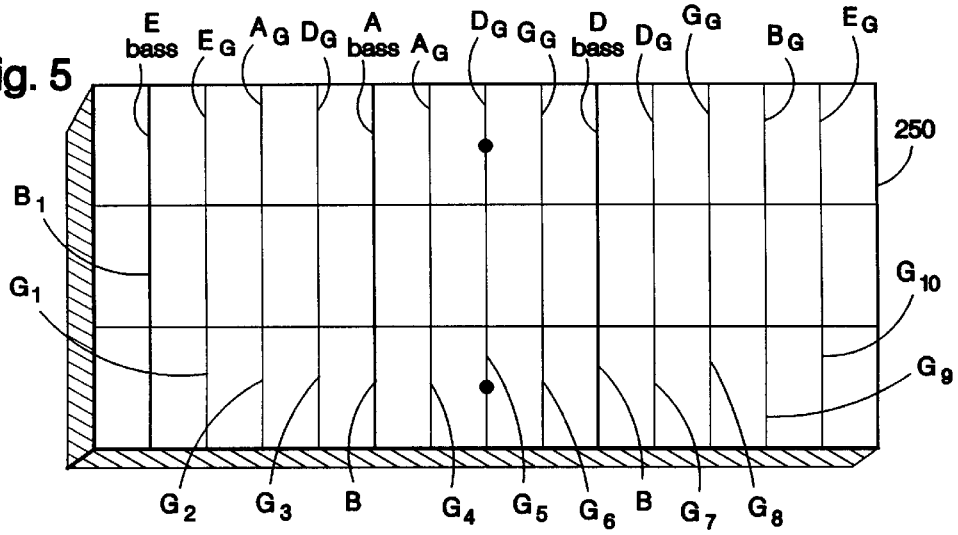
FIG. 5 is a front view of a portion of the fingerboard and strings of an alternative embodiment of the string instrument of the invention having thirteen strings.

FIG. 5 shows a section of a fingerboard 250 of a musical instrument 200 having the string orientation illustrated in Table 2. In FIG. 5, the string type and note are further indicated above each string, while the bass strings are further labeled B1–B3 and illustrated by the thicker lines, and the regular guitar strings are further labeled G1–G10 along the bottom of the Figure. As in FIGS. 3*a*–3*c*, the strings 230 in FIG. 5 are oriented so that the bass strings are adjacent to at least one guitar string tuned to the same note. See, for example, strings B1 and G1, B2 and G4, and B3 and G7. Thus, guitar and bass notes can be played virtually simultaneously as in the preferred embodiment. However, the ability of the instrument to function as a guitar has been further increased by adding another D guitar string (G3) between the first A guitar string (G2) and A bass string (B2). In addition, another G string (G6) is positioned between the second D guitar string (G5) and the D bass string (B3), and another E guitar string (G10) has been added after the B guitar string (G9). By adding the three guitar strings in the indicated positions, the ability of a musician using the instrument to play regular guitar chords is enhanced so that an E-A-D chord can be played by striking strings G1–G3, and A-D-G chord can be played by striking strings G4–G6, and a D-G-B-E chord can be played by striking strings G7–G10. In addition, any desired combination of such strings may be played simultaneously or in sequence in addition to playing bass and guitar portions simultaneously. Of course, the fingerboard 250, neck and other dimensions of the instrument will preferably be somewhat altered so that an attractive, sturdy, and balanced instrument results.

Figure 6:
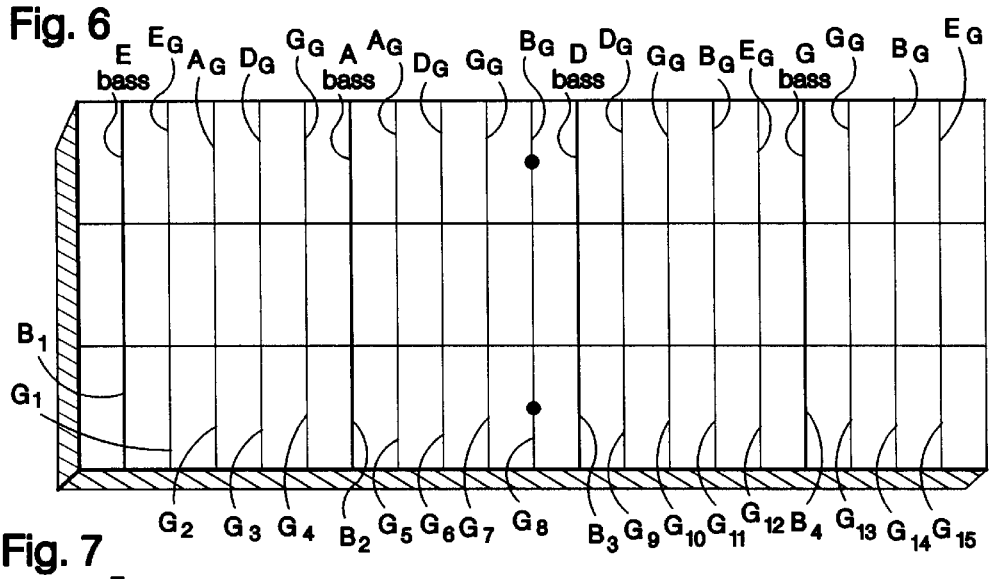
FIG. 6 is a front view of a portion of the fingerboard and strings of another alternative embodiment of the string instrument of the invention having nineteen strings.

FIG. 6 shows another alternative embodiment of the instrument. In FIG. 6, a portion of fingerboard 350 of the instrument 300 is shown wherein the instrument now contains 19 strings, labeled B1–B4 and G1–15, with the bass strings again indicated by the thicker lines in FIG. 6. The string arrangement of FIG. 6 is shown in Table 3 below:

TABLE 3

| String # | Note | Type of String (Guitar/Bass) |
|---|---|---|
| 1 | E | Bass |
| 2 | E | Guitar |
| 3 | A | Guitar |
| 4 | D | Guitar |
| 5 | G | Guitar |
| 6 | A | Bass |
| 7 | A | Guitar |
| 8 | D | Guitar |
| 9 | G | Guitar |
| 10 | B | Guitar |
| 11 | D | Bass |
| 12 | D | Guitar |
| 13 | G | Guitar |

TABLE 3-continued

| String # | Note | Type of String (Guitar/Bass) |
|---|---|---|
| 14 | B | Guitar |
| 15 | E | Guitar |
| 16 | G | Bass |
| 17 | G | Guitar |
| 18 | B | Guitar |
| 19 | E | Guitar |

The embodiment shown in FIG. 6 adds six strings to the embodiment shown in FIG. 5. A G-guitar string (G4 in FIG. 6) and a B-guitar string (B10) were added so that strings G1–G4 and G7–G10 are adjacent guitar notes E, A, D, G and A, D, G, B, respectively. This configuration significantly increases the instrument's ability to be played as a regular guitar across such portions of the fingerboard. In addition, strings 16–19 in Table 3, which are shown in FIG. 6 as G bass string (B4), followed by G guitar string (G17), B guitar string (G18), and E guitar string (G19), are also added. The addition of a G bass string (B4) gives the instrument the full functionality of a bass, which normally has E, A, D and G bass strings. In addition, the G bass string (B4) can be played simultaneously with the adjacent G guitar string (G16). Finally, the additional G, B, and E guitar strings (G17–19) also further increase the functionality of the instrument. In essence, a musician can choose the areas of the keyboard he or she wishes to play depending on the requirements of the particular piece or song being played.

Numerous other string arrangements following the principles of the invention accentuating or enriching particular sounds or chords are also envisioned. For example, Table 4 shows the instrument of the invention having pairs of adjacent similar noted guitar strings in the following orientation

TABLE 4

| String # | Note | Type of String (Guitar/Bass) |
|---|---|---|
| 1 | E | Bass |
| 2 | E | Guitar |
| 3 | E | Guitar |
| 4 | A | Guitar |
| 5 | A | Bass |
| 6 | A | Guitar |
| 7 | A | Guitar |
| 8 | D | Guitar |
| 9 | D | Bass |
| 10 | D | Guitar |
| 11 | D | Guitar |
| 12 | G | Guitar |
| 13 | G | Bass |
| 14 | G | Guitar |
| 15 | G | Guitar |
| 16 | B | Guitar |
| 17 | B | Guitar |
| 18 | E | Guitar |
| 19 | E | Guitar |

Figure 7:
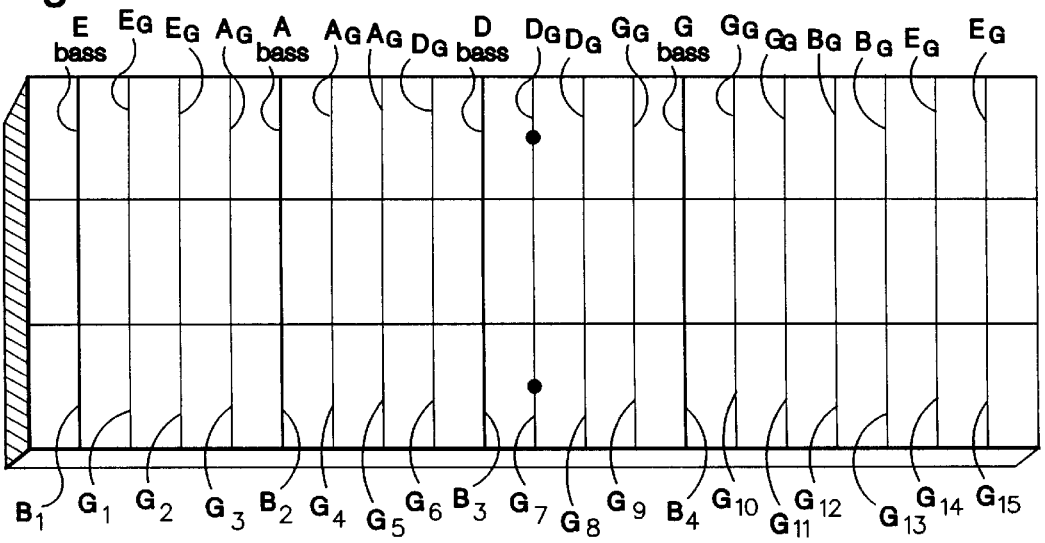
FIG. 7 is a front view of a portion of the fingerboard and strings of another alternative embodiment of the string instrument of the invention having repeating adjacent guitar strings.

As shown in FIG. 7, in the string arrangement of Table 4 at least one guitar string of each note is adjacent to another guitar string having the same note. For example, adjacent strings G1 and G2 in FIG. 7 are both E-guitar strings, and adjacent strings G4 and G5 are both A-guitar strings. The addition of adjacent pairs give the instrument the ability to play the music with a fuller or richer guitar sound, or tone, similar to the already known twelve-string acoustic guitar. Of course, the bass strings could also be situated in pairs to produce a richer bass sound, although usually it is the higher-pitched strings that are used for chords. In addition, each string in a pair may be tuned at different octaves to produce an even more unique sound.

Finally, as shown in FIG. 8, acoustic versions of the instrument following the same string arrangement principles are also contemplated. FIG. 8 shows acoustic guitar 500 having a hollow body portion 520, neck 540, head 560, and headmachines 562*a–j*. The body of the acoustic version can be of various shapes and dimensions, depending upon tones desired by the musician. For example, in an acoustic guitar, a smaller upper bout will enhance the treble frequencies, while a larger lower bout enhances the bass frequencies.

As will be evident from the several embodiments of the invention disclosed, a musician will normally select one or more of such embodiments, depending primarily on the skill of the musician, and memorize in conjunction with attentive practice the particular arrangement of strings and how they sound when played so that any sound form capable on said instrument, or at least a representative selection of such sounds or tones, can be attained upon demand. Because of the generally similar basic arrangement of all of the embodiments, however, performance virtuosity attained with any particular instrument of the series of embodiments can be fairly easily transferred to one of the other embodiments. For example, if a musician is familiar with an embodiment characterized by having a base string and a guitar string of the same note side by side may easily adapt to having the same guitar note on both sides of a bass string or note and a wider string selection across the fingerboard may be easily adapted to where the basic arrangement is an expansion of a narrower selection with the same order.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A stringed instrument comprising:

(a) a base portion;

(b) an elongated neck portion attached to said base portion; and (c) a plurality of strings attached to the body and neck portions, said plurality of strings consisting of guitar and bass strings arranged in order such that each of the bass strings is adjacent to at least one guitar string of a similar note.

2. The stringed instrument of claim 1 wherein at lease one of said bass strings have immediately adjacent on both sides of said guitar strings of a similar note.

3. The stringed instrument of claim 1 wherein each guitar string is adjacent to at least one other guitar string either tuned to the same note or a note following traditional E, A, D, G, B, E string order of a regular guitar.

4. The stringed instrument of claim 3 having a scale length of twenty-seven (27) inches.

5. The stringed instrument of claim 3 additionally comprising ten headmachines, each headmachine having a post, each post associated with one string.

6. The stringed instrument of claim 1 wherein the plurality of strings includes ten strings ordered, from highest to lowest, as an E bass string, an E guitar string, an A guitar string, an A bass string, a second A guitar string, a D guitar string, a D bass string, a second D guitar string, a G guitar string, and a B guitar string.

7. The instrument of claim 1 wherein the instrument is an electric instrument.

8. The instrument of claim 1 wherein the instrument is an acoustic instrument.

9. The stringed instrument of claim 1 wherein said plurality of strings includes thirteen strings, ordered from left to right as follows: E bass string, E guitar string, A guitar string, D guitar string, A bass string, A guitar string, D guitar string, G guitar string, D bass string, D guitar string, G guitar string, B guitar string, E guitar string.

10. The stringed instrument of claim 1 wherein said plurality of strings includes nineteen strings, ordered from left to right as follows: E bass string, E guitar string, A guitar string, D guitar string, G guitar string, A bass string, A guitar string, D guitar string, G guitar string, B guitar string, D bass string, D guitar string, G guitar string, B guitar string, E guitar string, G bass string, G guitar string, B guitar string, and E guitar string.

11. The stringed instrument of claim 1 wherein said plurality of strings includes nineteen strings ordered from left to right as follows: E bass string, E guitar string, E guitar string, A guitar string, A bass string, A guitar string, A guitar string, D guitar string, D bass string, D guitar string, D guitar string, G guitar string, G bass string, G guitar string, G guitar string, B guitar string, B guitar string, E guitar string, E guitar string.

12. A musical instrument comprising:

(a) a solid body;

(b) a neck attached to said solid body;

(c) a complement of strings secured between the neck and body, said complement of strings comprising ten strings in order from left to right an E bass string, an E guitar string, an A guitar string, an A bass string, a second A guitar string, a D guitar string, a D bass string, a second D guitar string, a G guitar string, and a B guitar string; and (d) an electronic pickup under the strings to detect vibration of said strings.

13. The musical instrument of claim 12 additionally comprising an expanded complement of strings to provide 13 strings, in order, an E bass string, E guitar string, A guitar string, D guitar string, A bass string, A guitar string, D guitar string, G guitar string, D bass string, D guitar string, G guitar string, B guitar string, and E guitar string.

14. The musical instrument of claim 12 additionally comprising an expanded complement of strings providing nineteen strings, ordered from left to right as follows: E bass string, E guitar string, A guitar string, D guitar string, G guitar string, A bass string, A guitar string, D guitar string, G guitar string, B guitar string, D bass string, D guitar string, G guitar string, B guitar string, E guitar string, G bass string, G guitar string, B guitar string, and E guitar string.

15. The musical instrument of claim 12 additionally comprising an expanded complement of strings providing nineteen strings ordered from left to right as follows: E bass string, E guitar string, E guitar string, A guitar string, A bass string, A guitar string, A guitar string, D guitar string, D bass string, D guitar string, D guitar string, G guitar string, G bass string, G guitar string, G guitar string, B guitar string, B guitar string, E guitar string, E guitar string.

16. A stringed instrument comprising:

(d) a plurality of strings extending between a body portion and a neck portion and tuned to guitar range, (b) at least one string tuned to bass range interspersed between the strings tuned to the guitar range, (c) said strings tuned to bass range being positioned immediately adjacent and between a first string tuned to the same note as a string tuned to the guitar range, but one octave higher and a second string tuned to a guitar range within one note of the base string, but approximately or essentially one octave higher.

17. A stringed instrument in accordance with claim 16 wherein the second string is tuned to the same note as the bass string.

18. A stringed instrument in accordance with claim 16 wherein the second string is tuned to the next higher note from the string on the other side of the bass string.

19. A stringed instrument in accordance with claim 16 wherein there are a plurality of strings tuned to bass range interspersed between strings tuned to guitar range.

20. A method of producing musical tones from a stringed instrument, said stringed instrument having a plurality of pairs of adjacent bass and guitar strings, comprising the step of tuning the adjacent bass and guitar strings to the same musical tone, and thereafter fingering the adjacent bass and guitar strings substantially simultaneously.

21. A method of producing musical tones from a stringed instrument in accordance with claim 20 wherein the adjacent pairs of bass and guitar strings are fingered in combination with other adjacent strings.

22. A method of producing musical tones from a stringed instrument in accordance with claim 20 wherein guitar strings adjacent the bass strings comprising each pair of the adjacent bass and guitar strings tuned to the same musical tone are initially tuned to a musical tone one octave higher than the adjacent pair and the adjacent strings are fingered substantially simultaneously.

* * * * *